US011148027B2

(12) United States Patent
Kam

(10) Patent No.: US 11,148,027 B2
(45) Date of Patent: Oct. 19, 2021

(54) COLLAPSIBLE SPORTS NET WITH QUICK RELEASE FOLDING CENTER JOINTS

(71) Applicant: Ao Jie Plastic Toys Factory Ltd., Kwun Tong (HK)

(72) Inventor: Chi Hang Kam, Kwun Tong (HK)

(73) Assignee: AO JIE Plastic Toys Factory Ltd., Kwun Tong (HK)

( * ) Notice: Subject to any disclaimer, the term of this patent is extended or adjusted under 35 U.S.C. 154(b) by 0 days.

(21) Appl. No.: 16/510,886

(22) Filed: Jul. 13, 2019

(65) Prior Publication Data

US 2021/0008424 A1 Jan. 14, 2021

(51) Int. Cl.

| | |
|---|---|
| ***A63B 63/00*** | (2006.01) |
| ***A63B 102/24*** | (2015.01) |
| ***A63B 102/14*** | (2015.01) |
| ***A63B 102/22*** | (2015.01) |

(52) U.S. Cl.

CPC ..... *A63B 63/004* (2013.01); *A63B 2063/005* (2013.01); *A63B 2102/14* (2015.10); *A63B 2102/22* (2015.10); *A63B 2102/24* (2015.10); *A63B 2210/50* (2013.01); *A63B 2243/0025* (2013.01)

(58) Field of Classification Search

CPC ..... A63B 63/00; A63B 63/004; F16C 11/10

See application file for complete search history.

(56) References Cited

U.S. PATENT DOCUMENTS

| | | | | | |
|---|---|---|---|---|---|
| 1,473,436 | A | * | 11/1923 | Leopold | B25G 1/063 81/58.3 |
| 4,286,353 | A | * | 9/1981 | Roche | E04B 1/3441 16/341 |
| 4,393,541 | A | * | 7/1983 | Hujsak | B25J 17/0241 16/291 |
| 5,178,583 | A | * | 1/1993 | Rankin | B64G 9/00 403/100 |
| 5,433,433 | A | | 7/1995 | Armell | |
| 5,476,266 | A | | 12/1995 | Caruso | |
| 5,539,957 | A | * | 7/1996 | Schmidt | A63B 63/004 16/254 |
| 5,561,874 | A | * | 10/1996 | Malofsky | A47D 13/063 428/36.4 |

(Continued)

FOREIGN PATENT DOCUMENTS

| | | |
|---|---|---|
| EP | 3 015 138 | 1/2018 |
| EP | 3051138 | 1/2018 |

*Primary Examiner* — Eugene L Kim
*Assistant Examiner* — Christopher Glenn
(74) *Attorney, Agent, or Firm* — LaMorte & Associates, P.C.

(57) ABSTRACT

A collapsible sports goal having frame elements and connector joint assemblies that interconnect the frame elements. Each of the connector joint assemblies receives and interconnects two separate frame elements. The connector joint assemblies have a first leg and a second leg that are joined by a hinge that enables movement between a parallel configuration and a perpendicular configuration. Each first leg has a spring-loaded locking finger extending therefrom and each second leg has a finger engagement hole therein. The locking finger on the first leg engages the finger engagement hole on the second leg when the first leg and the second leg are in their perpendicular configuration.

13 Claims, 7 Drawing Sheets

(56) References Cited

U.S. PATENT DOCUMENTS 5,681,045 A * 10/1997 Liao ..... A63B 63/004 273/400
5,954,600 A * 9/1999 Gill ..... A63B 63/004 473/478
6,409,410 B1 * 6/2002 Huang ..... F16C 11/10 403/112
6,672,980 B1 1/2004 Walsh
6,979,274 B1 12/2005 Raber
7,125,351 B1 10/2006 Raber
7,241,235 B2 7/2007 Caruso
7,850,576 B2 12/2010 Sellke
8,635,743 B2 * 1/2014 Smith ..... F16C 11/045 16/382
9,365,264 B2 * 6/2016 Perosino ..... E04H 15/06
9,909,617 B1 * 3/2018 Prey ..... E05D 11/10
10,124,233 B2 11/2018 Nelson et al.
10,286,274 B1 5/2019 Carretta
2003/0153412 A1 * 8/2003 Duba ..... A63B 63/004 473/478
2003/0166424 A1 * 9/2003 Wu ..... A63B 63/004 473/476
2004/0036222 A1 * 2/2004 Chou ..... A63B 63/004 273/407
2004/0197138 A1 * 10/2004 Reeves ..... A63B 63/004 403/300
2007/0281805 A1 * 12/2007 Hsiao ..... A63B 63/004 473/407
2009/0057505 A1 * 3/2009 Chen ..... F16M 11/28 248/185.1
2011/0105253 A1 * 5/2011 Wennesland ..... A63B 63/004 473/478
2012/0077629 A1 * 3/2012 Cerasoli ..... A63B 63/00 473/478
2012/0100940 A1 * 4/2012 Hajarian ..... A63B 63/004 473/476
2012/0184399 A1 * 7/2012 Reeves ..... F16B 7/0413 473/478
2013/0243520 A1 * 9/2013 Perosino ..... F16C 11/10 403/83
2013/0303313 A1 * 11/2013 Chen ..... A63B 63/004 473/478
2014/0171233 A1 * 6/2014 Huang ..... A63B 63/004 473/478
2015/0148152 A1 5/2015 Holland
2015/0217175 A1 8/2015 Carson et al.
2016/0356067 A1 * 12/2016 James ..... E05D 11/1014
2017/0009803 A1 * 1/2017 Parsons ..... E04H 15/001
2017/0120125 A1 5/2017 Nash
2017/0146055 A1 * 5/2017 Lowrey ..... F16C 11/10
2017/0304701 A1 10/2017 Nelson et al.
2019/0136906 A1 * 5/2019 Chen ..... F16C 11/04

* cited by examiner

COLLAPSIBLE SPORTS NET WITH QUICK RELEASE FOLDING CENTER JOINTS

BACKGROUND OF THE INVENTION

1. Field of the Invention

In general, the present invention relates to sports goals, such as those used as goals for soccer, hockey, lacrosse and the like. More particularly, the present invention relates to sports goals with folding corner joints that enable the sports goal to be selectively collapsed into a shape that is easier to store and carry.

2. Prior Art Description

Many sports, such as soccer, hockey, field hockey, lacrosse, and the like use goals that rest upon the ground. Such goals vary in dimensions depending upon the rules of the game being played. A great multitude of undersized goals also exist for use in practice and unofficial backyard play. Regardless of the size of the goal, sports goals tend to be large and bulky. As such, sports goals are difficult to package, difficult to transport and difficult to erect. It is for these reasons that many collapsible sports goals are available in the marketplace.

Collapsible sports goals are goals that are designed to be folded or disassembled when not in use. Such sports goals typically have corner joints that are used to interconnect various straight pieces of tubular frame. Often, the corner joints are fixed in shape. The tubular frame elements are simply connected to the corner joints when the sports net is erected and are disconnected from the corner joints when the net assembly is collapsed. That is, the sports goal is simply assembled when needed and dissembled for storage. Such prior art sports goals are U.S. Pat. No. 7,125,351 to Raber, entitled Portable Foldable Goal Assembly.

The problem associated with such prior art sports goals is that the sports goals take time and effort to assemble and disassemble. Furthermore, since the sports goal disassembles into pieces, all the pieces must be stored and carried together. If one piece gets misplaced, it may no longer be possible to properly assemble the sports goal. It is for this reason that many sports goals are made to be collapsible assemblies. In such a sports goal, the sports goal is assembled once by connecting straight tubular frame elements to hinged corner joints. The hinged corner joints have the ability to be adjusted between an open configuration and a collapsed configuration while remaining in an assembly with the tubular frame elements. The hinged corner joints typically have two sections that are joined at a hinge. A release mechanism is then used to enable the two sections to rotate about the hinge. Such prior art hinged corner joints are exemplified by U.S. Pat. No. 4,286,353 to Roche, U.S. Pat. No. 5,681,045 to Liao, and U.S. Patent Application Publication No. 2016/0356067 to James.

A problem associated with such prior art hinged corner joints is that the mechanism that controls the locking and release of the hinge is often complicated to manufacture and difficult to operate. This is especially true for hinged corner joints on toy play goals that are typically erected and collapsed by children at play.

A need therefore exists for a sports goal that is collapsible yet has a simple release mechanism. A need also exists for a sports goal with hinged corner joints that are inexpensive to manufacture and simple to use. These needs are met by the present invention as described and claimed below.

SUMMARY OF THE INVENTION

The present invention is a collapsible sports goal. The sports goal has a framework made from a plurality of frame elements that are interconnected with a plurality of connector joint assemblies. Each of the plurality of connector joint assemblies receives and interconnects two separate frame elements from the plurality of frame elements.

Each of the connector joint assemblies has a first leg and a second leg that are joined together by a hinge. The hinge enables the first leg and the second leg to move between a parallel configuration and a perpendicular configuration. When in a parallel configuration, the sports goal is collapsed with the frame elements densely stacked. In the perpendicular configuration, the sports goal is fully erected and ready for use.

In each connector assembly, the first leg has a spring-loaded locking finger extending therefrom. Additionally, the second leg has a finger engagement hole therein. The locking finger on the first leg engages the finger engagement hole on the second leg when the first leg and the second leg are in the perpendicular configuration. This locks the first leg and the second leg into the perpendicular configuration. The first leg and the second leg can be selectively rotated into the parallel configuration by manually pressing the locking finger on the first leg out of engagement with the second leg. The simple mechanical connection and release makes the sports goal easy to both erect and collapse.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention sports goal can be embodied in many ways, the embodiment illustrated is configured as a play soccer goal for use by children. This embodiment is selected in order to set forth one of the best modes contemplated for the invention. The illustrated embodiment, however, is merely exemplary and should not be considered a limitation when interpreting the scope of the appended claims.

Figure 1:
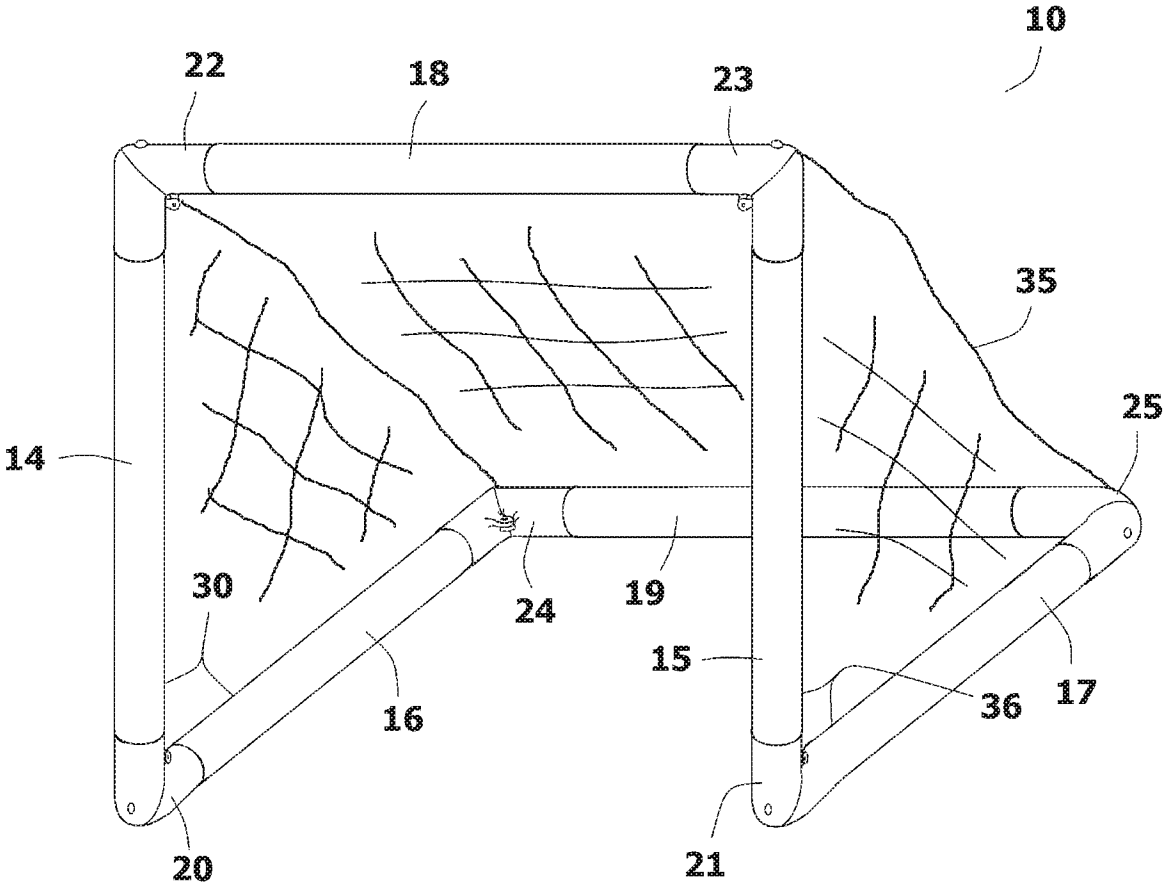
FIG. 1 is a perspective view of an exemplary embodiment of a sports goal fully assembled and in an open configuration.
Figure 2:
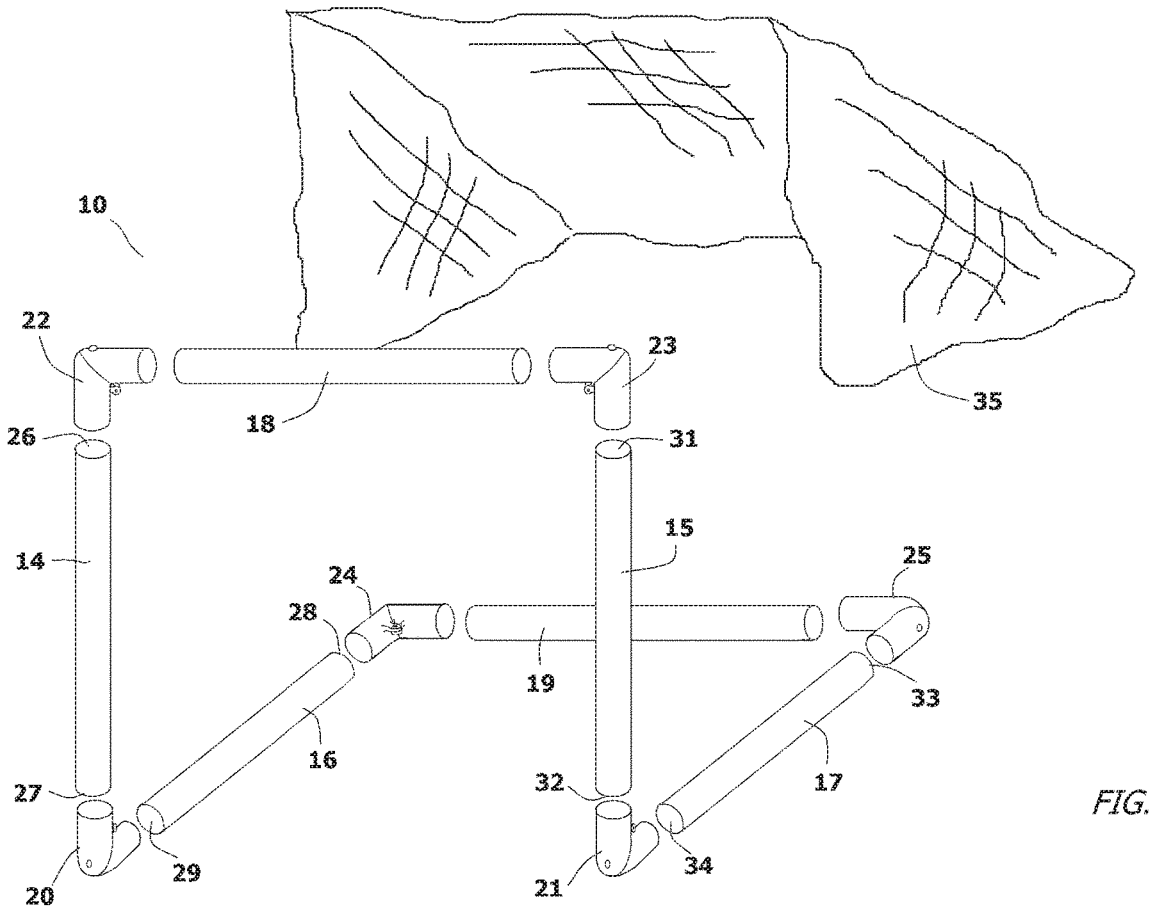
FIG. 2 is an exploded view of the exemplary embodiment of FIG. 1.

Referring to FIG. 1 in conjunction with FIG. 2, a sports goal 10 is shown. The sports goal 10 has a collapsible framework 12 that is made from six straight frame elements 14, 15, 16, 17, 18, 19 and six connector joint assemblies 20, 21, 22, 23, 24, 25. As will be later explained, the six connector joint assemblies 20, 21, 22, 23, 24, 25 are identical in shape and design, therein making the overall sports goal 10 both easy to operate and inexpensive to manufacture.

The six frame elements 14, 15, 16, 17, 18, 19 include two vertical frame elements 14, 15, two horizontal frame elements 16, 17, a long top frame element 18, and a long bottom frame element 19. The long top frame element 18 and the long bottom frame element 19 have the same length. Likewise, the vertical frame elements 14, 15 have the same length and the horizontal frame elements 16, 17 have the same length. The vertical frame elements 14, 15 and the horizontal frame elements 16, 17 are also equal in length.

The first vertical frame element 14 has a first end 26 and a second end 27. The first horizontal frame element 16 also has a first end 28 and a second end 29. The second end 27 of the first vertical frame 14 element and the second end 29 of the first horizontal frame element 16 are joined together by the first connector joint assembly 20. The first connector joint assembly 20 enables the first vertical frame element 14 and the first horizontal frame element 16 to be selectively positioned between an open configuration and a folded configuration. In the open configuration, illustrated in FIG. 1, the first vertical frame element 14 and the first horizontal frame element 16 are joined together at a perpendicular by the first connector joint assembly 20, therein forming a first L-shaped side frame structure 30. In the closed configuration, as is later illustrated in FIG. 3 and FIG. 4, the first vertical frame element 14 and the first horizontal frame element 16 lay next to each other in parallel.

The second vertical frame element 15 has a first end 31 and a second end 32. The second horizontal frame element 17 also has a first end 33 and a second end 34. The second end 32 of the second vertical frame element 15 and the second end 34 of the second horizontal frame element 17 are joined together by the second joint assembly 21. The second joint assembly 21 enables the second vertical frame element 15 and the second horizontal frame element 17 to be selectively positioned between an open configuration and a folded configuration. In the open configuration, illustrated in FIG. 1, the second vertical frame element 15 and the second horizontal frame element 17 are oriented at a perpendicular, therein forming a second L-shaped side frame structure 36. In the closed configuration, as is later illustrated in FIG. 3, the second vertical frame element 15 and the second horizontal frame element 17 lay next to each other in parallel.

Flexible netting 35 is provided that attaches to each of the frame elements 14, 15, 16, 17, 18, 19 and each of the six connector joint assemblies 20, 21, 22, 23, 24, 25. The netting 35 is flexible enough so as not to hinder the folding and unfolding of the sports goal 10.

The long top frame element 18 extends between the first end 26 of the first vertical frame element 14 and the first end 31 of the second vertical frame element 15. The long top frame element 18 engages the first end 26 of the first vertical frame element 14 with the third connection joint assembly 22. The opposite end of the long top frame element 18 engages the first end 31 of the second vertical frame element 15 with the fourth connection joint assembly 23. When the sports goal 10 is fully erect, such as is shown in FIG. 1, the first vertical frame element 14, the second vertical frame element 15, and the long top frame element 18 form three sides of the rectangular front opening of the sports goal 10.

The long bottom frame element 19 extends between the first end 28 of the first horizontal frame element 16 and the first end 33 of the second horizontal frame element 17. The long bottom frame element 19 engages the first end 28 of the first horizontal frame element 16 with the fifth connection joint assembly 24. The opposite end of the long bottom frame element 19 engages the first end 33 of the second horizontal frame element 17 with the sixth connection joint assembly 25. When the sports goal 10 is fully erect, such as is shown in FIG. 1, the first horizontal frame element 16, the second horizontal frame element 17, and the long bottom frame element 19 form three sides of the rectangular base of the sports goal 10.

It will be understood that six separate connector joint assemblies 20, 21, 22, 23, 24, 25 are utilized within the sports goal 10. All six of the connector joint assemblies 20, 21, 22, 23, 24, 25 are identical in structure and are interchangeable. Referring to FIG. 3, FIG. 4, FIG. 5, and FIG. 6 in conjunction with FIG. 2, the common design of each of the connector joint assemblies 20, 21, 22, 23, 24, 25 is described. Each connector joint assembly 20, 21, 22, 23, 24, 25 has a first leg 40 and a second leg 42. The first leg 40 and the second leg 42 are permanently interconnected by a hinge 45. The hinge 45 enables the first leg 40 the second leg 42 to move independently of each other.

The first leg 40 has a tubular casing 44 that extends along a first central axis 46 between a first end 47 and an opposite second end 48. The first leg 40 defines a receptacle 50 that is accessible through the first end 47. The receptacle 50 is sized and shaped to receive the end of one of the frame elements 14, 15, 16, 17, 18, 19 with a friction fit connection. The second end 48 of the first leg 40 is angled at a forty-five degree angle with respect to the first central axis 46. A spring-loaded locking finger 52 extends from the first leg 40 of each of the connector joint assemblies 20, 21, 22, 23, 24, 25 in a direction parallel to the first central axis 46. The spring-loaded locking finger 52 is biased into an extended position by its internal spring 54. In the extended position, the locking finger 52 extends farther beyond the second end 48 of the first leg 40. However, the locking finger 52 can be retracted when engaged by a force in opposition of the spring 54 that is stronger than the spring 54. When retracted, the locking finger 52 can withdraw to a position behind the second end 48 of the first leg 40.

The second leg 42 has a tubular casing 56 that extends along a second central axis 57 between a first end 58 and an opposite second end 59. The second leg 42 defines a receptacle 60 that is accessible through the first end 58. The receptacle 60 is sized and shaped to receive the end of one of the frame elements 14, 15, 16, 17, 16, 19 with a friction fit connection. The second end 59 of the second leg 42 is angled at a forty-five degree angle with respect to the second central axis 57. A finger engagement hole 62 is formed in the second leg 42 just before the second end 59.

Figure 3:
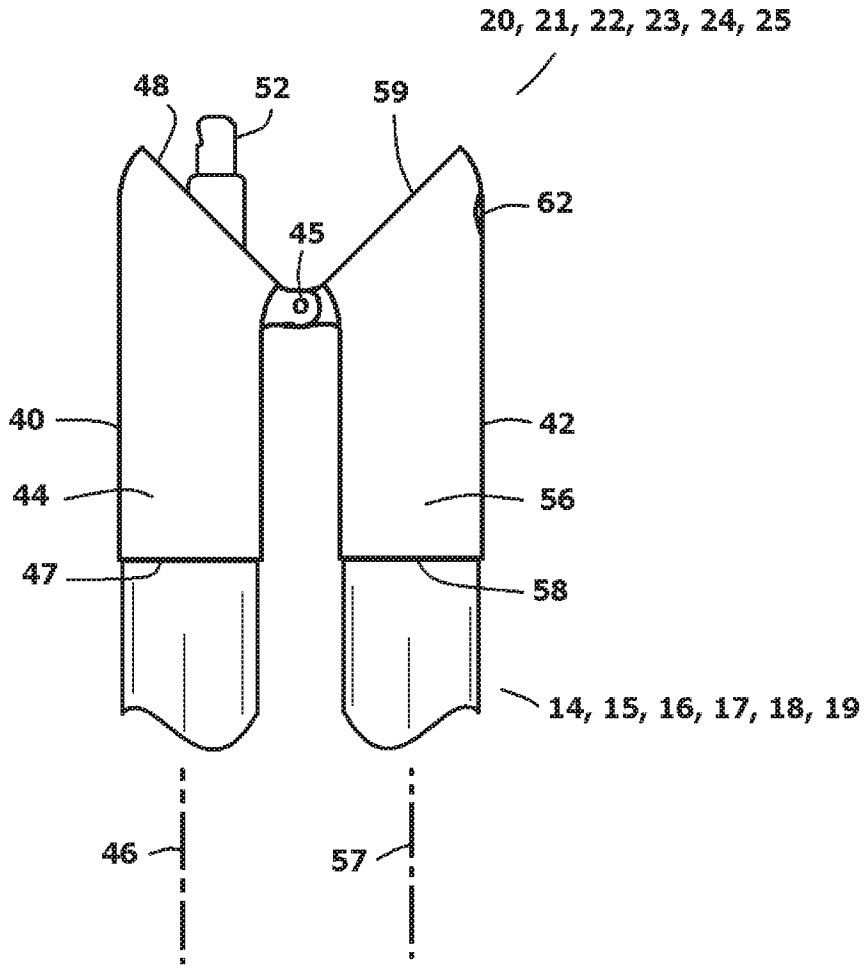
FIG. 3 is a fragmented view of a connector joint assembly in a folded configuration and joining two straight frame elements.
Figure 4:
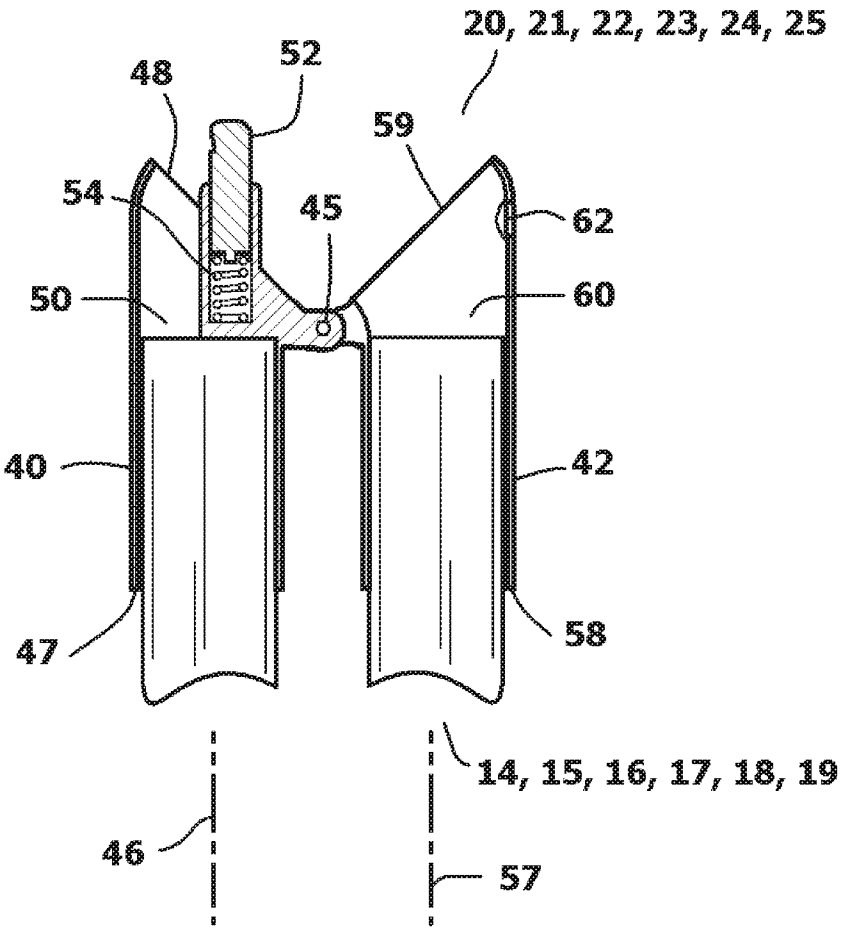
FIG. 4 is a cross-section of the fragmented view of FIG. 3.

Referring to FIG. 3 and FIG. 4, it can be seen that when a connector joint assembly 20, 21, 22, 23, 24, 25 is in its folded configuration, the first central axis 46 of the first leg 40 and the second central axis 57 of the second leg 42 are parallel. Furthermore, the first leg 40 is only connected to the second leg 42 by the hinge 45.

Figure 5:
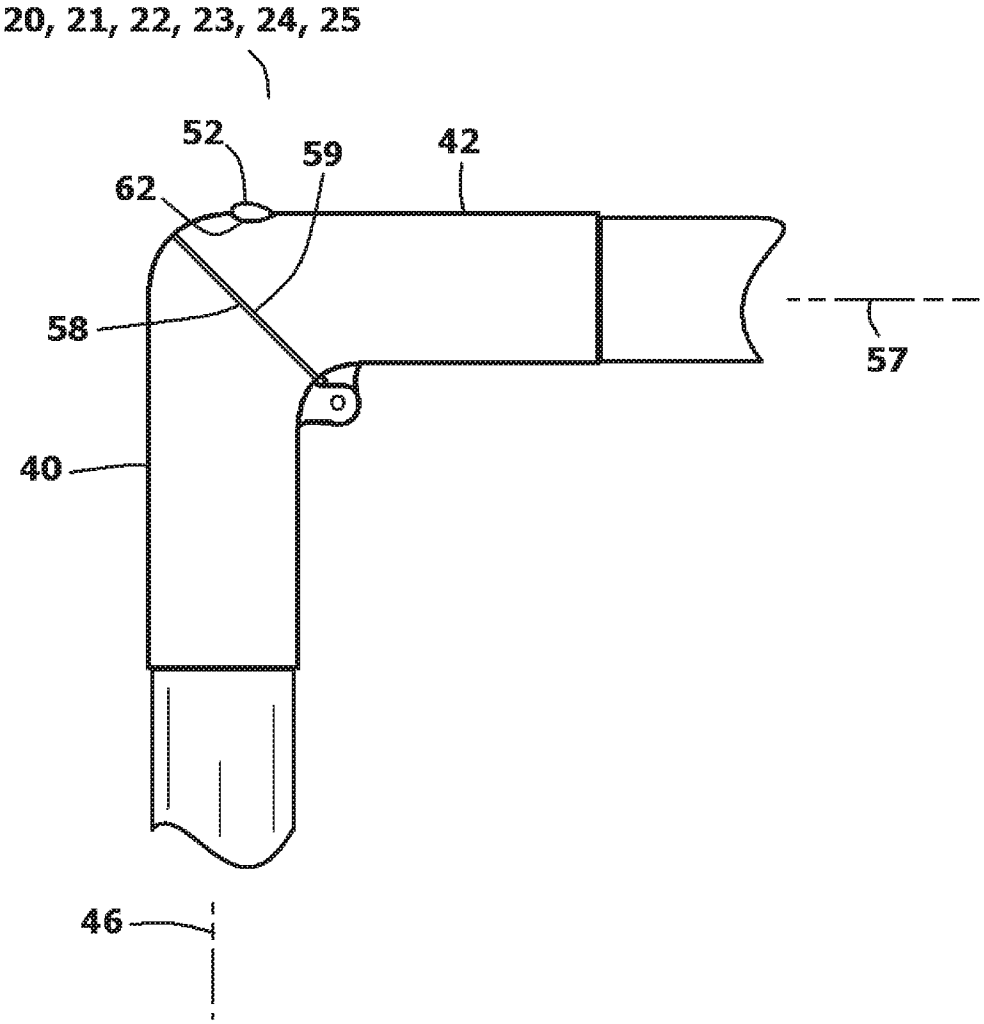
FIG. 5 is a fragmented view of a connector joint assembly in an open configuration and joining two straight frame elements.
Figure 6:
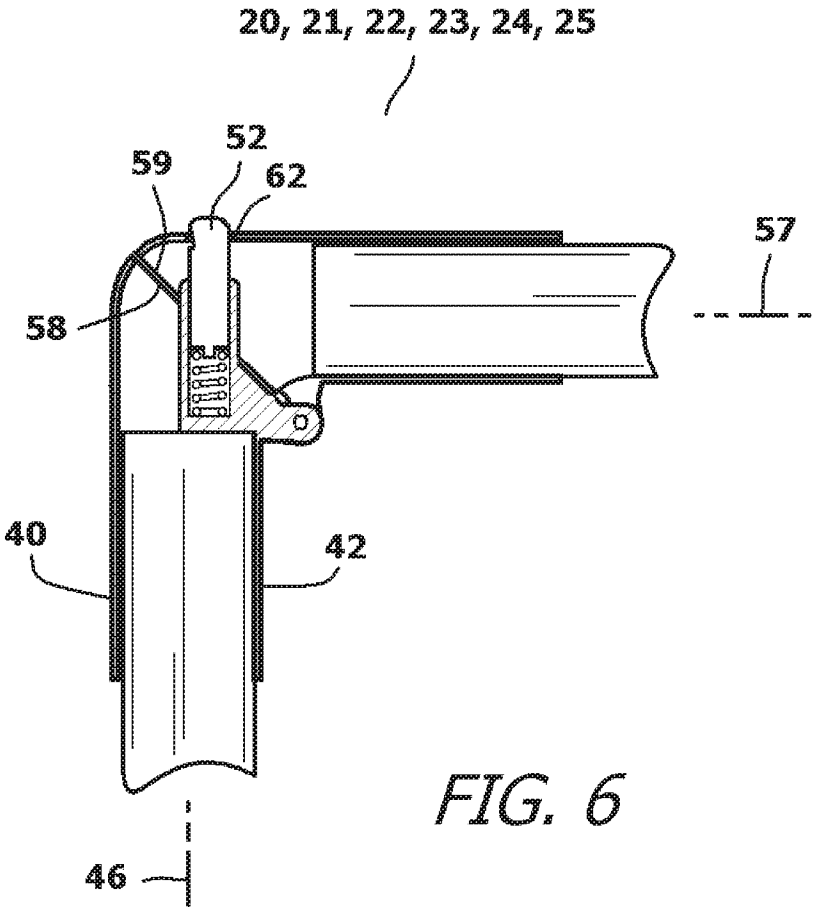
FIG. 6 is a cross-section of the fragmented view of FIG. 5.

Referring to FIG. 5 and FIG. 6, it can be seen that when connector joint assemblies 20, 21, 22, 23, 24, 25 are in their closed configurations, the second end 48 of the first leg 40 abuts against the second end 59 of the second leg 42. This positions the first central axis 46 of the first leg 40 at a perpendicular to the second central axis 57 of the second leg 42. Furthermore, the spring-loaded locking finger 52 extends from the first leg 40 into the second leg 42, wherein the locking finger 52 interconnects with the finger engagement hole 62 in the second leg 42. The engagement of the locking finger 52 with the finger engagement hole 62 locks the first leg 40 into a set position relative the second leg 42. As such, the subject connector joint assembly 20, 21, 22, 25 is locked into its right-angle open configuration. The subject connector joint assembly 20, 21, 22, 23, 24, 25 can only be returned to its folded configuration by manually depressing the locking finger 52 and pushing out of contact with the finger engagement hole 62.

Figure 7:
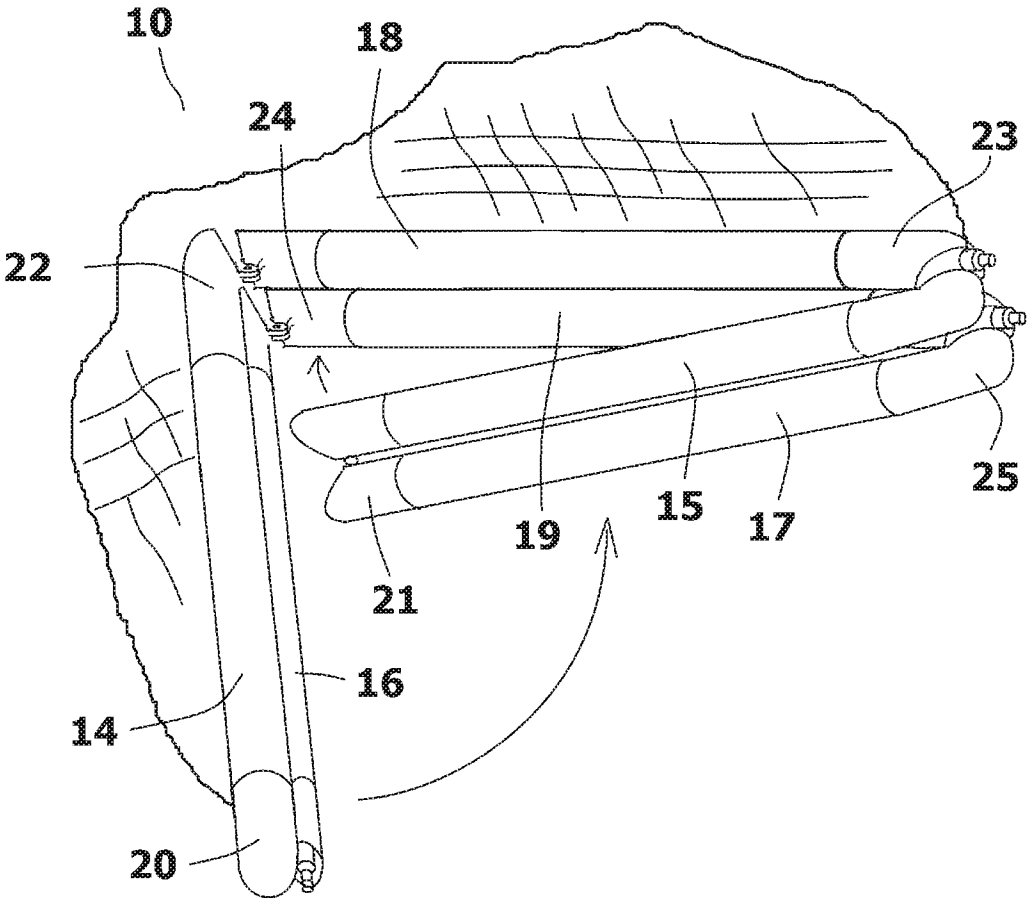
FIG. 7 shows the sports goal of FIG. 1 in a folded configuration.

Referring to FIG. 7 in conjunction with FIG. 1 and FIG. 2, it will be understood that the sports goal 10 may be initially packaged unassembled with the straight frame elements 14, 15, 16, 17, 18, 19 detached from the connector joint assemblies 20, 21, 22, 23, 24, 25. The parts are initially assembled by the purchaser. Once assembled, the sports goal 10 remains assembled. However, by folding the connector joint assemblies 20, 21, 22, 23, 24, 25, the sports goal 10 can be configured into a folded configuration for transportation and/or storage. The folded configuration is shown in FIG. 7.

It will be understood that the embodiment of the present invention that is illustrated and described is merely exemplary and that a person skilled in the art can make many variations to that embodiment. All such embodiments are intended to be included within the scope of the present invention as defined by the claims.

What is claimed is:

1. A collapsible sports goal comprising:

a plurality of frame elements, wherein each of said plurality of frame elements has opposed ends;

a plurality of connector joint assemblies that interconnect said plurality of frame elements at said ends, wherein each of said plurality of connector joint assemblies has a first leg and a second leg that receive and interconnect two separate frame elements from said plurality of frame elements, wherein each said first leg has a first tubular casing that extends in a first direction along a first central axis between a first end and an opposite second end, and wherein each said second leg has a second tubular casing that extends along a second central axis, wherein said first leg and said second leg are joined by a hinge that enables said first leg and said second leg to move between a parallel configuration and a perpendicular configuration;

a spring-loaded locking finger that extends from said first leg in a parallel direction to said first central axis, wherein said spring-loaded locking finger moves in said parallel direction between an extended position and a retracted position, and wherein said spring-loaded locking finger is biased into an extended position by a spring;

wherein when in said extended position, said spring-loaded locking finger extends in said first direction beyond said second end of said first casing and when in said retracted position said spring-loaded locking finger is positioned between said first end and said second end of said first casing;

a finger engagement hole formed through said second tubular casing of said second leg, wherein said spring-locking finger on said first leg passes through and engages said finger engagement hole on said second tubular casing when said first leg and said second leg are in said perpendicular configuration, therein locking said first leg and said second leg into said perpendicular configuration.

2. The sports goal according to claim 1, wherein said second tubular casing of each said second leg has a first end and an opposite second end.

3. The sports goal according to claim 2, wherein said second end of said first tubular casing is angled at forty-five degrees with respect to said first central axis and said second end of said second tubular casing is angled at forty-five degrees with respect to said second central axis.

4. The sports goal according to claim 3, wherein said second end of said first tubular casing abuts against said second end of said second tubular casing when in said perpendicular configuration.

5. The sports goal according to claim 4, wherein said spring-loaded locking finger can be selectively manually depressed from said extended position to said retracted position.

6. The sports goal according to claim 1, wherein said first leg and said second leg of said connector joint assemblies define receptacles for receiving said plurality of frame elements.

7. The sports goal according to claim 1, wherein each of said plurality of connector joint assemblies are identical.

8. The sports goal according to claim 1, wherein said plurality of frame elements include two vertical frame elements, two horizontal frame elements, a top frame element and a bottom frame element, wherein said two vertical frame elements and said two horizontal frame elements share a common length.

9. The sports goal according to claim 8, wherein said top frame element and said bottom frame element share a common length.

10. A collapsible sports goal comprising: a first vertical frame element and a second vertical frame element; a first horizontal frame element and a second horizontal frame element; a top frame coupled to said first vertical frame element with a first connector joint assembly and coupled to said second vertical frame element with a second connector joint assembly; a bottom frame element coupled to said first horizontal frame element with a third connector joint assembly and coupled to said second horizontal frame element with a fourth connector joint assembly; wherein said first vertical frame element is coupled to said first horizontal frame element with a fifth connector joint assembly and said second vertical frame element is coupled to said second horizontal frame element with a sixth connector joint assembly; wherein said first connector joint assembly, said second connector joint assembly, said third connector joint assembly, said fourth connector joint assembly, said fifth connector joint assembly and said sixth connector joint assembly are identical and all contain a first leg and a second leg that are joined by a hinge that enables said first leg and said second leg to move between a parallel configuration and a perpendicular configuration; wherein said first leg has a first tubular casing that extends in a first direction along a first central axis between a first end and a second end, and said second leg has a second tubular casing that extends along a second central axis; a locking finger extending from said first leg, wherein said locking finger moves parallel to said first axis between an extended position and a retracted position, wherein when in said extended position said locking finger extends in said first direction beyond said second end of said first casing, and when in said retracted position said locking finger is positioned between said first end and said second end of said first casing; a finger engagement hole formed through said second tubular casing of said second leg, wherein said locking finger on said first leg extends through and engages said finger engagement hole on said second leg when said first leg and said second leg are in said perpendicular configuration, therein locking said first leg and said second leg into said perpendicular configuration.

11. The sports goal according to claim 10, wherein said second end of said first tubular casing is angled at forty-five degrees with respect to said first central axis and said second tubular casing has a second end that is angled at forty-five degrees with respect to said second central axis.

12. The sports goal according to claim 11, wherein said second end of said first tubular casing abuts against said second end of said second tubular casing when in said perpendicular configuration.

13. The sports goal according to claim 12, wherein said locking finger can be selectively manually depressed into said first tubular casing.

* * * * *